United States Patent [19]

De Maat et al.

[11] Patent Number: 4,964,231

[45] Date of Patent: Oct. 23, 1990

[54] FRONT-MOUNT GRID FRAME

[75] Inventors: H. Thomas De Maat, Holland; H. Jay Schoeppe, II, Hudsonville, both of Mich.

[73] Assignee: Silent Sound Systems, Inc., Grand Rapids, Mich.

[21] Appl. No.: 205,414

[22] Filed: Jun. 10, 1988

[51] Int. Cl.[5] ..... A47G 1/06

[52] U.S. Cl. ..... 40/152; 40/155; 40/156

[58] Field of Search ..... 40/152, 156, 152.1, 40/155, 605

[56] References Cited

U.S. PATENT DOCUMENTS

| | | | |
|---|---|---|---|
| 2,218,409 | 10/1940 | Smalls | 40/152 |
| 2,914,872 | 12/1959 | Goodrich | 40/124 |
| 2,940,606 | 6/1960 | Kurnitz . | |
| 3,523,382 | 8/1970 | Dreyer | 40/605 |
| 3,648,393 | 3/1972 | Parrilla | 40/152 |
| 4,034,496 | 7/1977 | Cohen | 40/152 |
| 4,043,477 | 8/1977 | Deese | 220/23.4 |
| 4,050,498 | 9/1977 | Lucchetti | 403/402 |
| 4,115,938 | 9/1978 | Belmuth et al. | 40/152 |
| 4,145,827 | 3/1979 | Katsufrakis | 40/152 |
| 4,209,922 | 7/1980 | Porreca | 40/155 |
| 4,349,974 | 9/1982 | Rapayelian | 40/156 |
| 4,356,648 | 11/1982 | Beaulieu | 40/155 |
| 4,368,584 | 1/1983 | Logan | 40/152 |
| 4,384,826 | 9/1982 | Reim | 40/155 |
| 4,385,459 | 5/1983 | McGrath et al. | 40/124.4 |
| 4,497,125 | 2/1985 | Hutchinson | 40/124 |
| 4,532,727 | 8/1985 | Klose et al. | 40/152 |
| 4,608,770 | 9/1986 | Gray | 40/152 |
| 4,669,209 | 6/1987 | Pollack | 40/156 |
| 4,706,397 | 11/1987 | Hesener | 40/152 |

*Primary Examiner*—Gene Mancene
*Assistant Examiner*—Cary E. Stone
*Attorney, Agent, or Firm*—Warner, Norcross & Judd

[57] ABSTRACT

A grid display for presenting an array of display inserts within a common peripheral frame includes a plurality of first frame members positioned to form the common peripheral frame, a plurality of inner frame members positioned within the frame and arranged in a grid pattern to define a plurality of display insert receiving openings, and a plurality of connector elements receiving and mounting the frame members in their proper positions. The connector elements include peripheral gaps for receiving a portion of the first frame members, and specially configured channels along their front faces to receive the second frame members in their grid pattern. Retaining strips are releasably mounted to the frame members to facilitate front insertion and removal of the display inserts from the display without disassembly of the frame members.

33 Claims, 10 Drawing Sheets

FRONT-MOUNT GRID FRAME

BACKGROUND OF THE INVENTION

The present invention pertains to grid displays, and in particular to a modular system for assembling grid displays.

Grid displays have gained increasing popularity for use in restaurants, lobbies, etc. Essentially, grid displays are wall-mounted units employed to present a plurality of pictures in juxtaposition to form an array of pictures mounted within a common peripheral frame. Typically, grid displays have been comprised of a plurality of self-contained individual frame units coupled together to form a series of picture-containing openings. However, such a system requires a large inventory of frame units of differing sizes to even provide a modest variety of available displays.

Past artisans have developed limited modular systems involving elongated members utilized to define a plurality of openings. Examples of such assemblies are illustrated in U.S. Pat. 4,209,922 issued July 1, 1980 to Porreca and entitled ADJUSTABLE AND KNOCK-DOWN PICTURE FRAME CONSTRUCTION, and U.S. Pat. 4,145,827 issued Mar. 27, 1979 to Katsufrakis and entitled ASSEMBLY FOR THE DISPLAY OF PICTURES. However, these assemblies have a weak construction, limited design versatility and fail to provide either a common peripheral frame or a protective transparent panel positioned over the pictures. Moreover, these systems require the disassembly of the entire display to change the pictures mounted therein.

SUMMARY OF THE INVENTION

In accordance with the present invention, a unique modular grid display comprised of a small inventory of parts is provided to enable the secure and variable mounting of an array of display inserts within a common peripheral frame.

The grid display includes frame members which may be cut to the desired length to suit each specific display. The frame members are mounted and oriented into a grid pattern through their cooperative interconnection with specially-designed connector elements. Retaining strips or VELCRO elements are further provided to effect a front mounting of the display inserts within the defined openings.

The user, by employing the grid display of the present invention, may easily construct a secure framework adapted to mount the desired array of display inserts in a wide range of variations in size and shape. This system requires the maintenance of only a small inventory, despite the great versatility offered. Further, due to the front-mounting capability, the insert array may be easily changed or modified without disassembling the erected grid pattern.

These and other objects, advantages and features of the present invention will be more fully understood and appreciated by reference to the written specification an appended drawings.

DETAILED DESCRIPTION OF THE PREFERRED EMBODIMENTS

Figure 1:
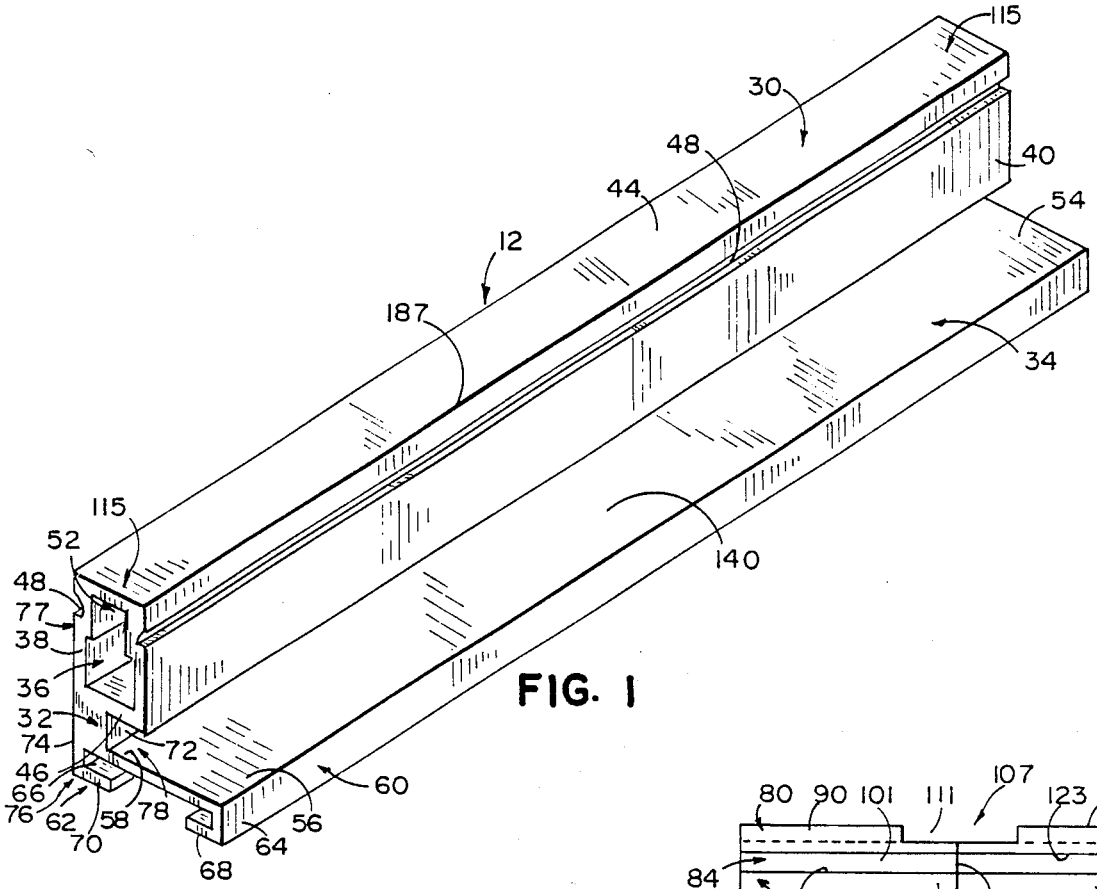
FIG. 1 is a perspective view of a frame member of the present invention.
Figure 2:
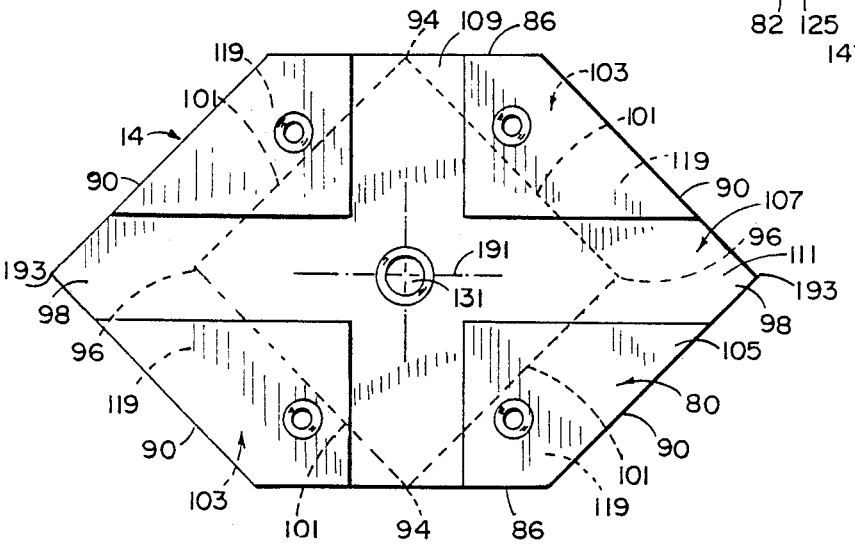
FIG. 2 is a front elevational view of a main connector element of the present invention.
Figure 10:
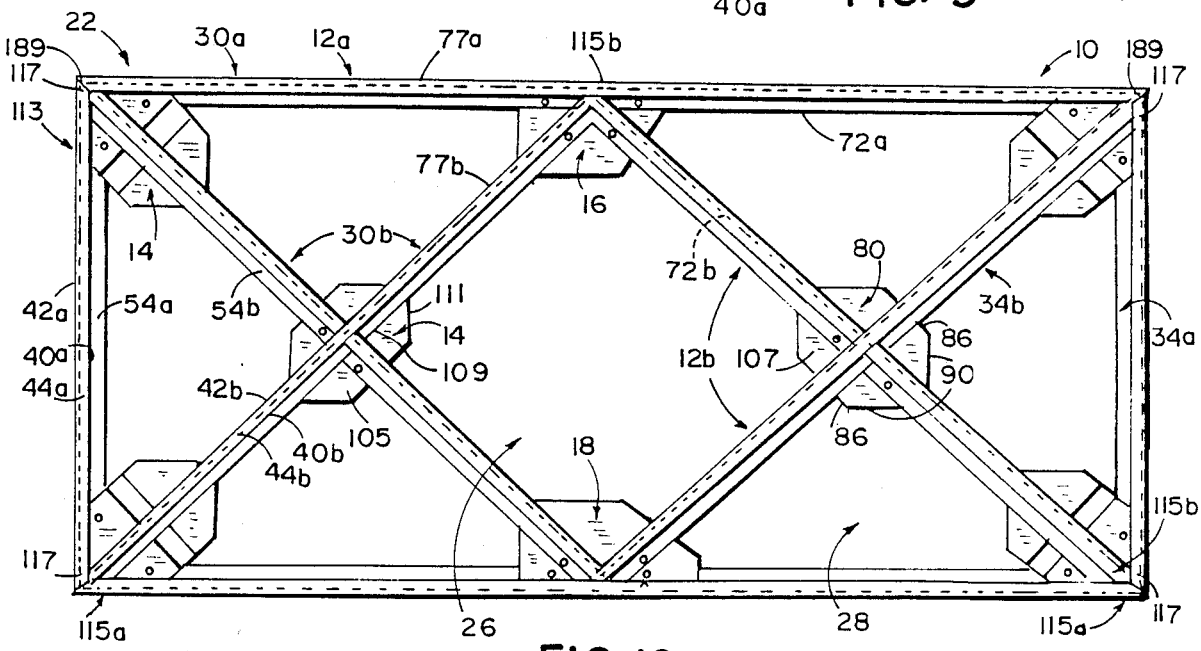
FIG. 10 is a front elevational view of the grid display formed in a diagonal grid pattern.
Figure 13:
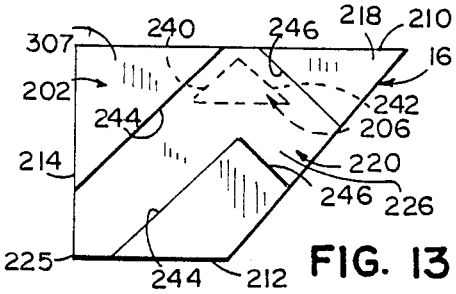
FIG. 13 is a front view of the connector of FIG. 11.
Figure 16:
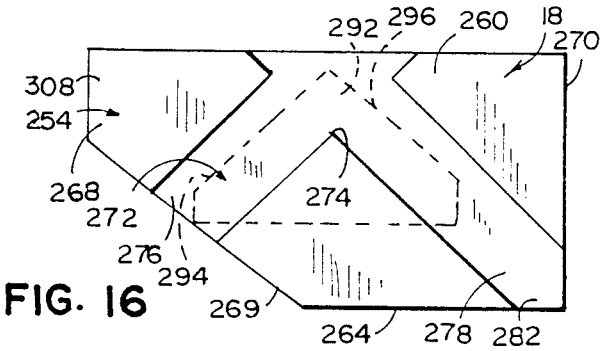
FIG. 16 is a front view of the connector of FIG. 12.
Figure 14:
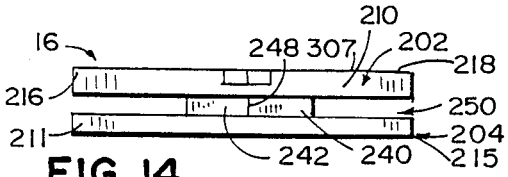
FIG. 14 is a side view of the connector of FIG. 13.
Figure 17:
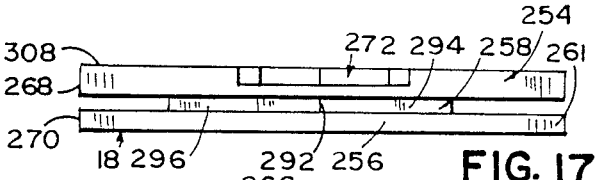
FIG. 17 is a side view of the connector of FIG. 16.
Figure 15:
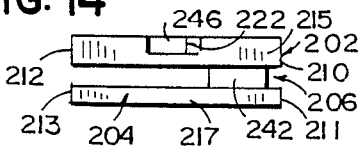
FIG. 15 is an end view of the connector of FIG. 13.
Figure 18:
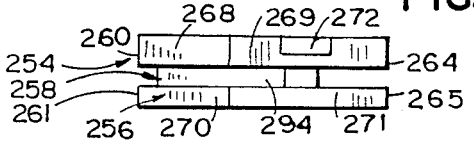
FIG. 18 is an end view of the connector of FIG. 16.

In the preferred embodiment, modular grid display 10 includes a plurality of elongated frame members 12 (FIG. 1) and connector elements 14, 16, 18 (FIGS. 2, 13 and 16). Frame members 12 may be arranged into either a rectangular grid 20 (FIG. 5) or an angular grid 22 (FIG. 10). While in the illustrated embodiments only a few display insert openings 24, 26, 28 are defined, the displays may be constructed to have any number. Further, the size of the openings may be given any dimension needed to suit the specific display insert 29.

Frame members 12, regardless of the grid type 20, 22 formed or the size of display, comprise the same basic configuration. More specifically, frame members 12 are preferably extruded of plastic or aluminum to form a head 30, a neck 32 and a base 34 all integrally composed as a one-piece, unitary member (FIG. 1). Head 30 is a substantially rectangular hollow block having a central cavity 36 and a marginal wall 38 which defines a pair of opposite parallel sidewalls 40, 42, a top wall 44 and a bottom wall 46. Each sidewall 40, 42 is provided with a shallow groove 48 extending along the length thereof for the mounting of retaining strips 50 as will be discussed below.

Grooves 48 are formed to have an arcuate upper surface 49 and a planar base surface 51 to facilitate the releasable mounting of retaining strips 50. However, a variety of other shapes could be utilized to facilitate the same mounting connection. Further, to better accommodate grooves 48 and increase the structural integrity of frame members 12, cavity 36 is narrowed along its upper portion 52 to increase the thickness of marginal wall 38.

Base 34 underlies head 30 in a spaced apart relationship and, in the preferred embodiment, has an inverted channel shape. More particularly, base 34 includes an upper wall 54 having a broad width to extend outwardly beyond the width of head 30. Projecting downwardly from each side 56, 58 thereof is a dog leg flange 60, 62 having upper segments 64, 66 projecting orthogonally downward and lower segments 68, 70 projecting inwardly toward one another. This shape maximizes the structural strength of base 34 while minimizing the material requirements and hence cost. This shape of base 34 also defines a cavity 71 which may receive therein support members utilized to additionally strengthen the joints formed by abutting and intersecting frame members 12. Nevertheless, other shapes could of course be used.

Interconnecting base 34 and head 30 is a reduced neck 32 having sides 72, 74. Side 74 is preferably aligned with sidewall 42 and side surface 76 of upper segment 66 to define a continuous rear surface 77 of frame member 12. In contrast, side 72 forms with head 30 and base 34 a recess 78 adapted to receive portions of connecting elements 14, 16, 18 as will be described below. In smaller dimensioned frame members 12, neck 32 may be eliminated if desired.

Connecting elements 14, 16, 18 (FIGS. 3, 13 and 16) are at the heart of the grid display 10 and function to mount, orient and interconnect the numerous frame members 12 into the desired design. In assembling a rectangular grid display 20, frame members 12 are mounted solely through the use of main connecting elements 14. Alternative connecting elements 16, 18 are additionally employed in the formation of an angular grid display 22.

Figure 4:
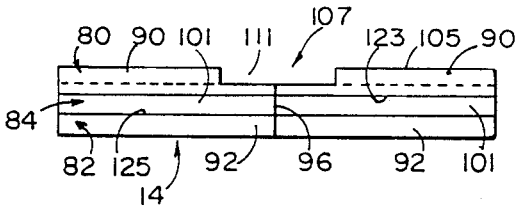
FIG. 4 is an end view of the main connector element.
Figure 3:
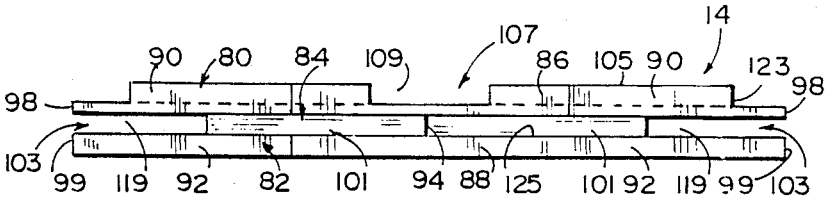
FIG. 3 is a side elevational view of the main connector element.
Figure 5:
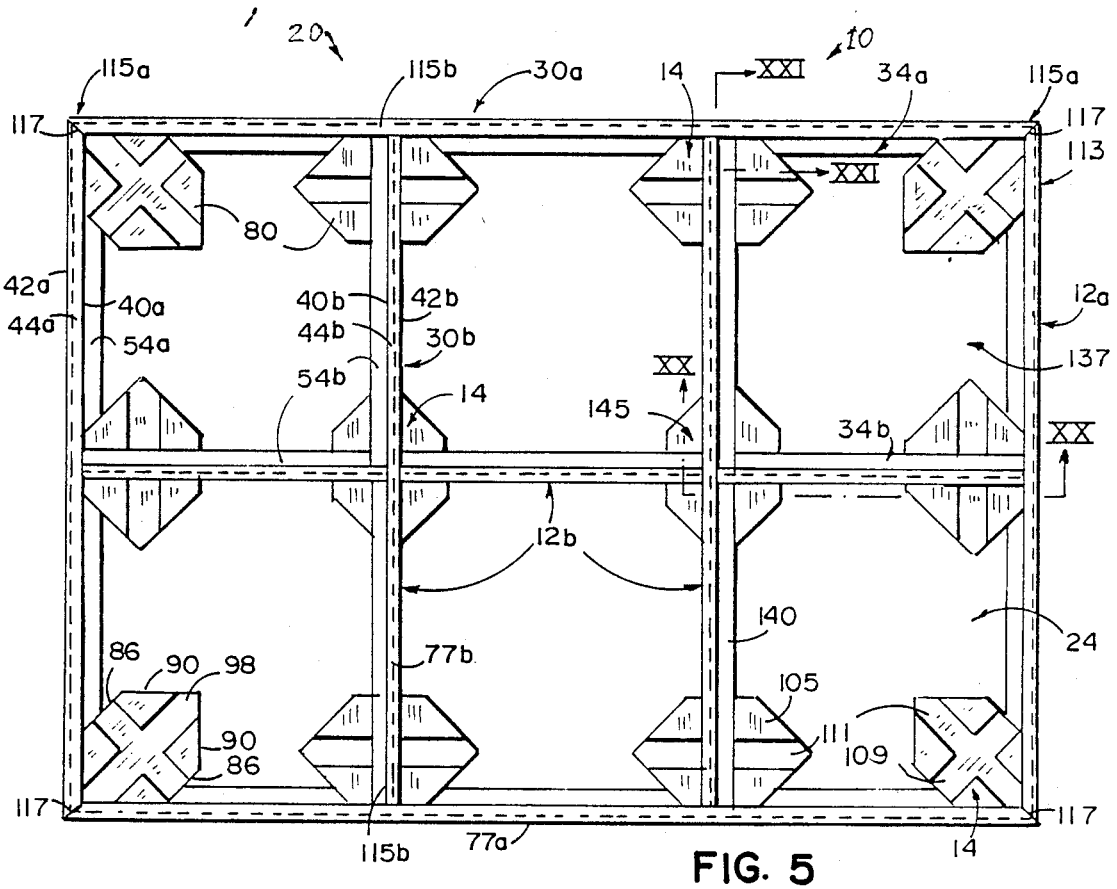
FIG. 5 is a front elevational view of a grid display of the present invention forming a rectangular grid.

Main connecting elements 14 have a three-layer construction including a front layer 80, a rear layer 82 and an interlayer 84 (FIGS. 3–5). Front and rear layers 80, 82 are planar members having a generally flattened, hexagonal shape, which define base edges 86, 88 and side edges 90, 92. Interlayer 84 is sandwiched between front and rear layers 80, 82 and is bonded therewith to form a single, integral article. Also, main connecting elements 14 may be fabricated, by molding or machining, as a single-piece unitary member having the same three-layer form. Interlayer 84 is also a planar member, but has a generally square configuration of reduced dimension. More specifically, interlayer 84 includes four corners 94, 96 oriented such that two corners 94 extend outwardly to align with base edges 86, 88 at their midpoints, and two corners 96 are offset from but in line with corners 98, 99 of front and rear layers 80, 82. In this orientation, interlayer edges 101 are offset from side edges 90, 92 in a substantially parallel relationship therewith to form a pair of opposed chevron-shaped gaps 103 between front and rear layers 80, 82. Furthermore, outer face 105 of front layer 80 is provided with a cross-shaped channel 107 formed by a first passage 109 extending medially between base edges 86 and a second passage 111 which extends between corners 98.

As seen in FIG. 5, a grid display of the rectangular grid type 20 includes four outer frame members **12*a* which are interconnected by main connecting elements 14 into a generally rectangular configuration to form a common peripheral frame 113 encompassing the entire array of display inserts. Positioned within outer frame members 12*a* are a plurality of inner frame members 12*b* which are oriented both vertically and horizontally, to divide the common peripheral frame 113 into a plurality of rectangular or square insert receiving openings 24. While openings 24 are generally identical in shape and dimension (as seen in FIG. 5**), they could be formed in a non-uniform manner if desired.

Figure 6:
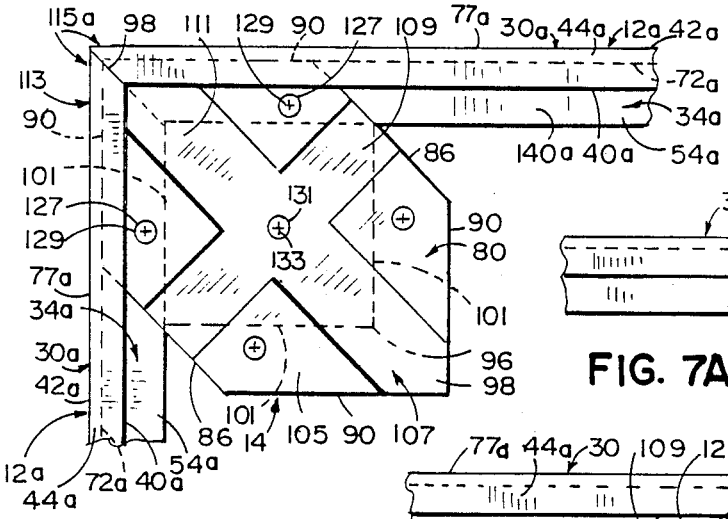
FIG. 6 is a front view of a corner of the grid display of FIG. 5.

Outer frame members **12*a* are mitered at their ends 115*a* and placed in abutting relation with one another to form corners 117 of peripheral frame 113. Outer frame members 12*a* are secured into place through the use of main connector elements 14 positioned in corners 117. More specifically, at each corner 117, a pair of frame members 12*a* and a connector 14 are oriented in an overlapping relationship, such that bases 34*a* are matingly received within one of the chevron gaps 103 (FIG. 6). More particularly, a base 34*a* of one frame member 12*a* is received into each leg 119 of the engaged chevron gap 103, such that upper wall 54*a* and lower segments 70*a* are received snugly between the inner faces 123, 125 of front and rear layers 80, 82, respectively. Furthermore, gaps 103 are dimensioned such that side edges 90 of front layer 80 abuttingly engage side 72*a* of neck 32*a*, and upper segment 66*a* engages interlayer edges 101**.

Bores 127 are formed through front and rear layers 80, 82 of connecting element 14 and bases **34*a* of frame members 12*a* to receive therethrough fasteners 129 such as screws or the like to fixedly secure the three components together (FIG. 6). Furthermore, a mounting bore 131 is provided centrally through main connector element 14 for the receipt of a fastener 133 to securely mount the unit to a wall or other supporting member 135. Bores 127, 131** may be either preformed or formed during assembly.

Figure 7A:
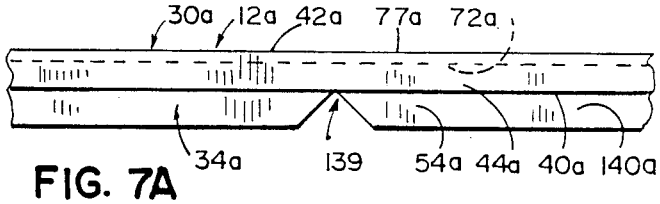
FIG. 7A is a front view of the frame member illustrated in FIG. 7.
Figure 7:
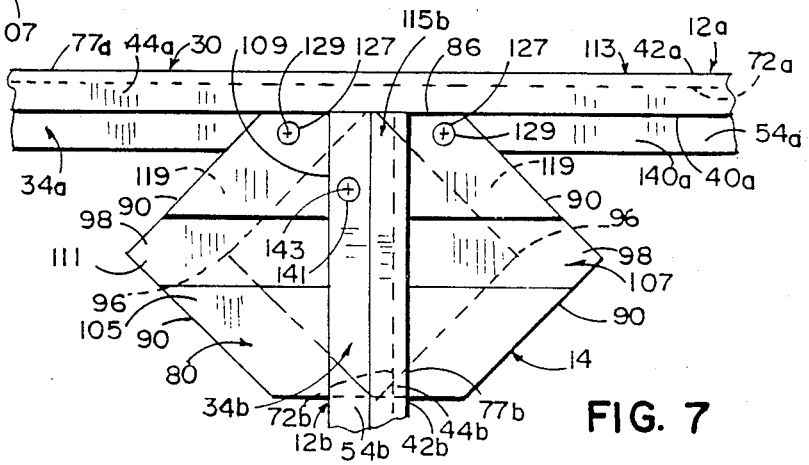
FIG. 7 is a front view of an end intersection of the grid display of FIG. 5.

Inner frame members **12*b* are positioned to extend entirely across the rectangular opening 137 defined by peripheral frame 113, such that its ends 115*b* engage sidewall 40*a* of head 30*a*. This is accomplished through the mounting of a main connector element 14 on an outer frame member 12*a* such that one base edge 86 of front layer 80 engages sidewall 40*a* of head 30*a* or side 72*a* of neck 32*a* (FIG. 7). To accommodate the projecting corner 94 of interlayer 84 and to aid in positioning and retaining connector element 14 in its proper position, base 34*a* of outer frame member 12*a* is provided with a substantially V-shaped notch 139 (FIG. 7A**).

This orientation positions portions of base 34a within adjacent end portions of opposed chevron gaps 103. Also, similarly to the corner connection of outer frame members 12a with connector element 14, bores 127 are formed through front and rear layers 80, 82 of connector 14 and base 34a of frame member 12a to each side of first passage 109 to receive fasteners 129 therethrough.

Figure 20:
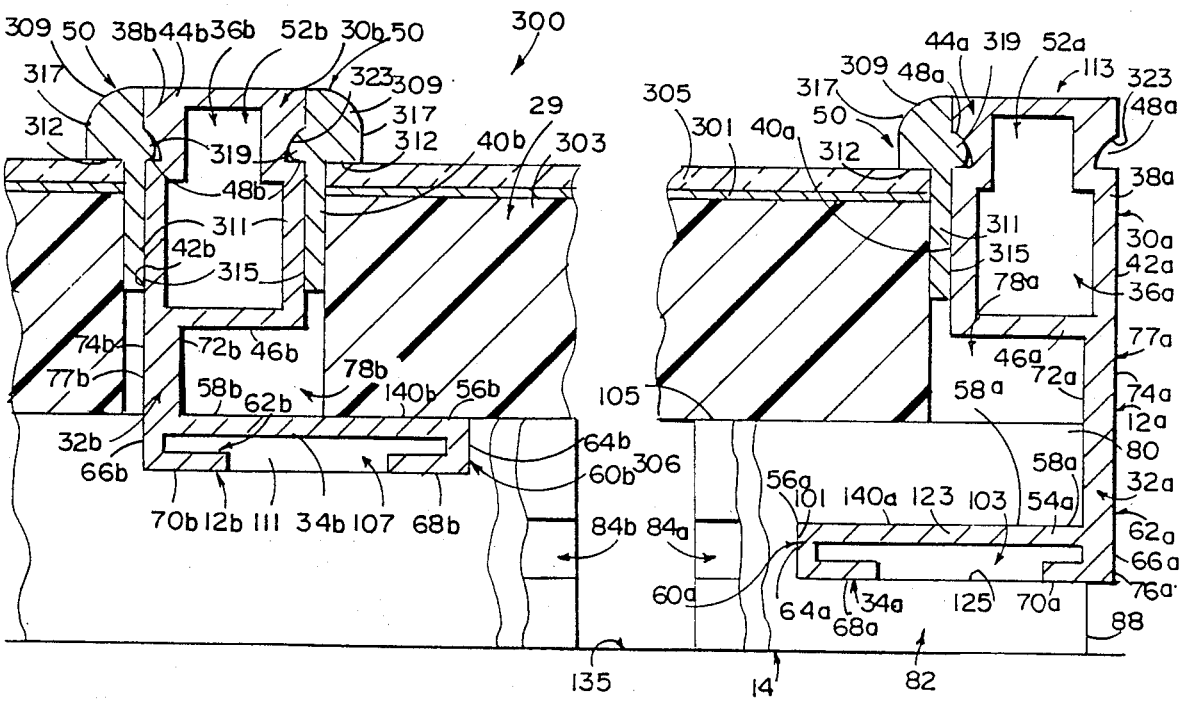
FIG. 20 is a cross-sectional view of a first embodiment taken along line XX—XX in FIG. 5.
Figure 24:
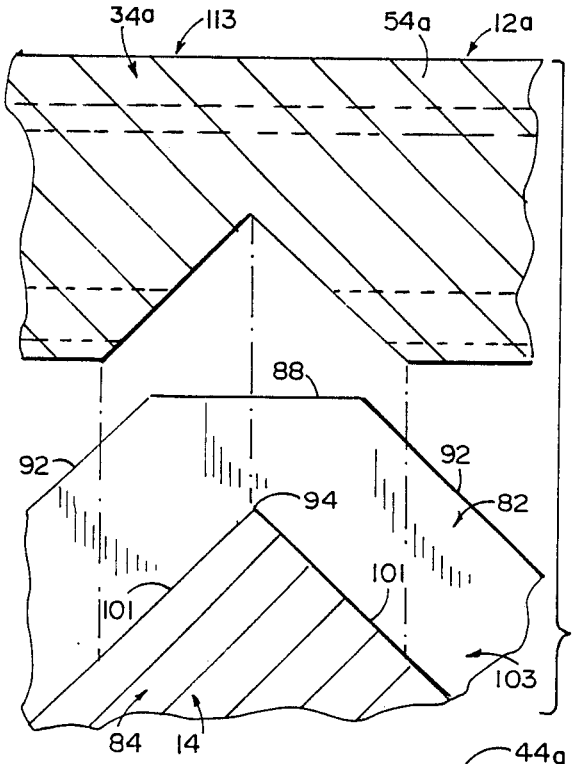
FIG. 24 is an exploded view of FIG. 22.
Figure 22:
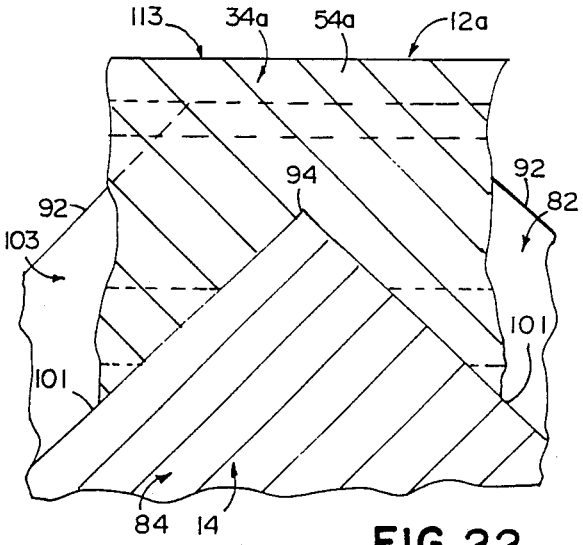
FIG. 22 is a cross-sectional view taken along line XXII—XXII in FIG. 21.
Figure 23:
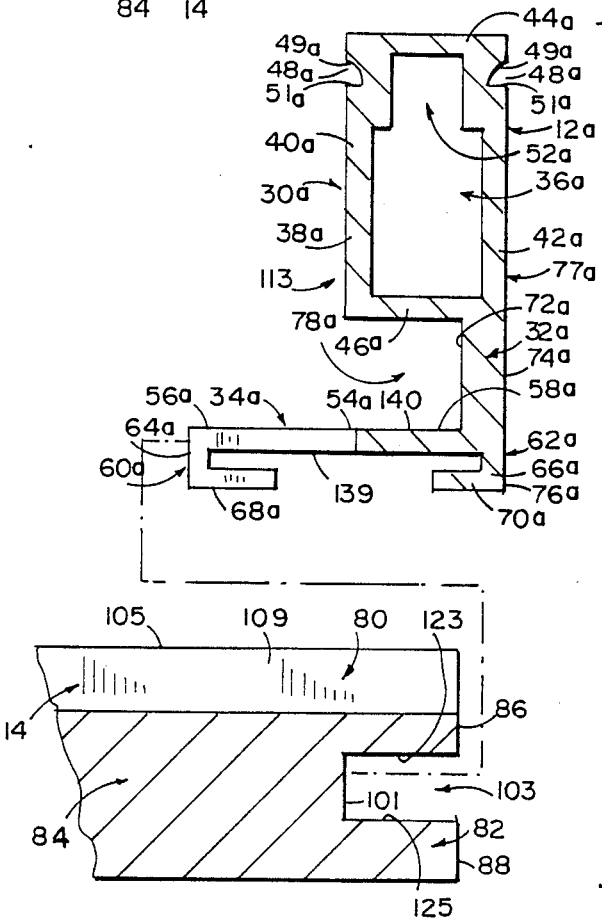
FIG. 23 is an exploded view of FIG. 21.
Figure 21:
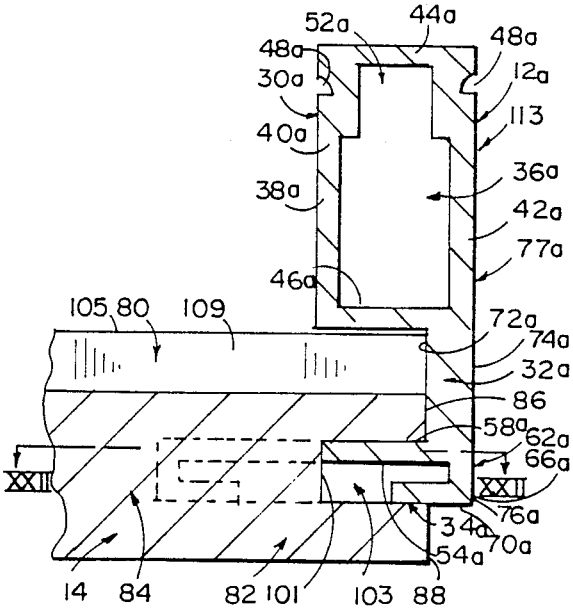
FIG. 21 is a cross-sectional view taken along line XXI—XXI in FIG. 5 with the inner frame member omitted for clarity.

Inner frame members 12b are positioned on connector element 14 such that bases 34b are matingly received within first passage 109. Preferably, the depth of first passage 109 substantially equals the height of upper segments 64b, 66b so that outer face 105 of front layer 80 lies substantially within the same plane as the base's upper surface 140b (FIG. 20). To securely maintain inner frame members 12b within first passages 109, at least one bore 141 is formed through base 34b and into connector 14 for the passage of a fastener such as a screw 143.

To maintain the uniformity of the appearance of outer and inner frame members 12a, 12b, the height of inner frame members 12b is reduced a distance equal to a thickness of front layer 80 as compared to outer frame members 12a. As best seen in FIG. 20, this positions the top walls 44a, 44b of all frame members 12 within the same plane. Further, outer and inner frame members 12a, 12b preferably have identical base portions 34, to facilitate the use of outer members 12a as inner members used in conjunction with a correspondingly larger frame member (not shown), or the use of inner members 12b as outer members used in conjunction with a correspondingly smaller frame member (not shown). This kit format of grid display 10 enables the use of the same connector elements 14, 16, 18, regardless of the size of the frame member 12.

Figure 8:
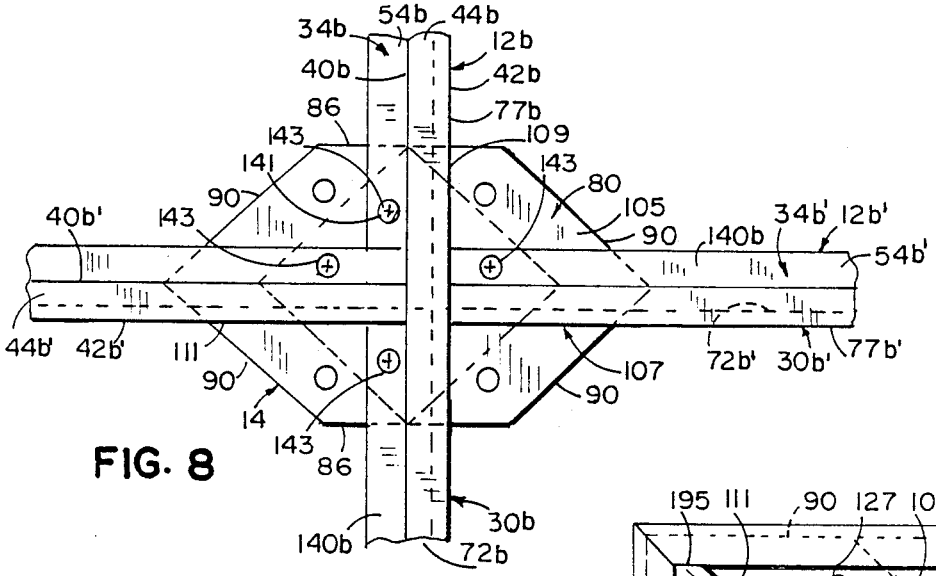
FIG. 8 is a front view of a crossing intersection of the grid display of FIG. 5.
Figure 25:
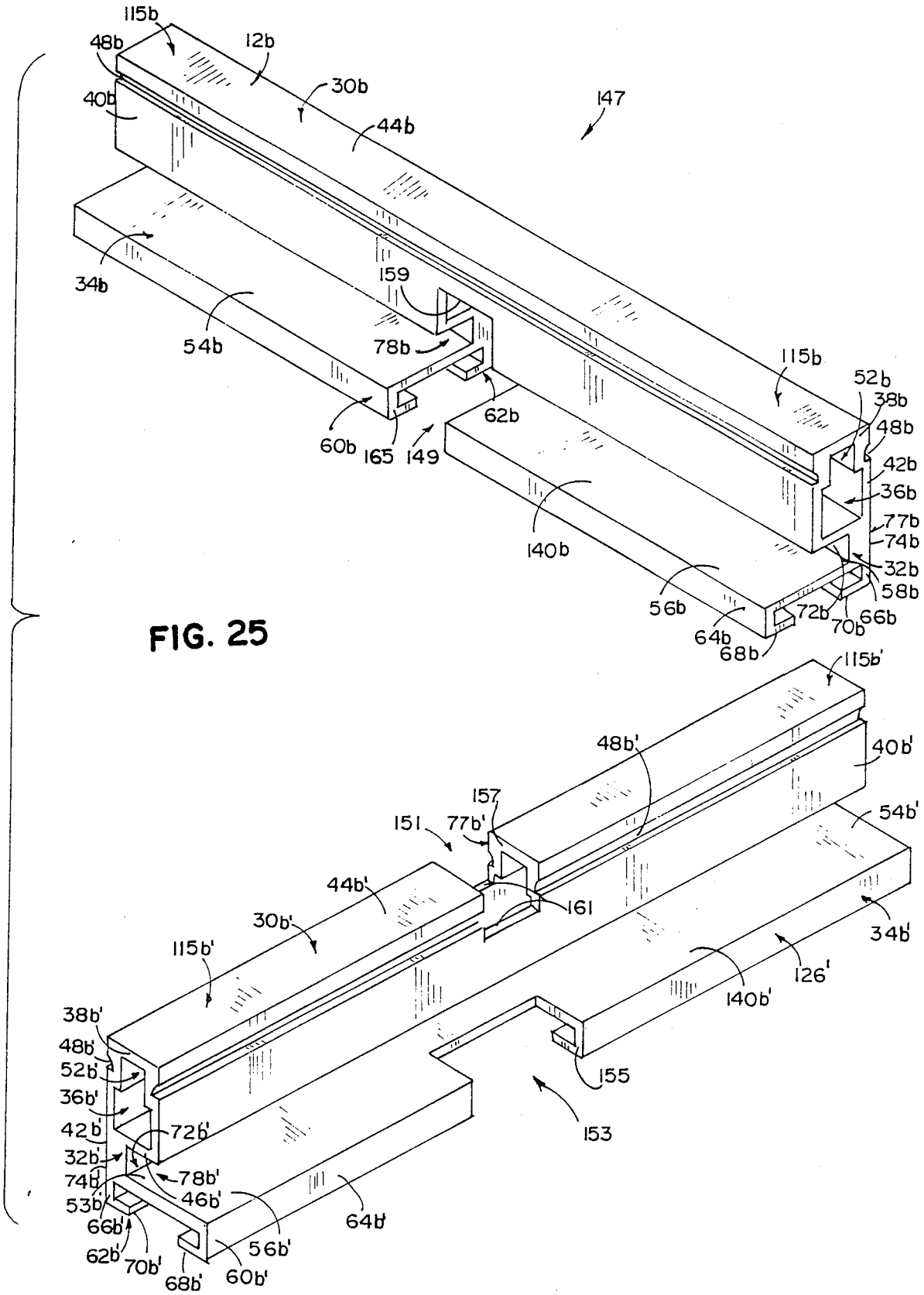
FIG. 25 is an exploded view of a first embodiment of a pair of intersecting frame members.
Figure 27:
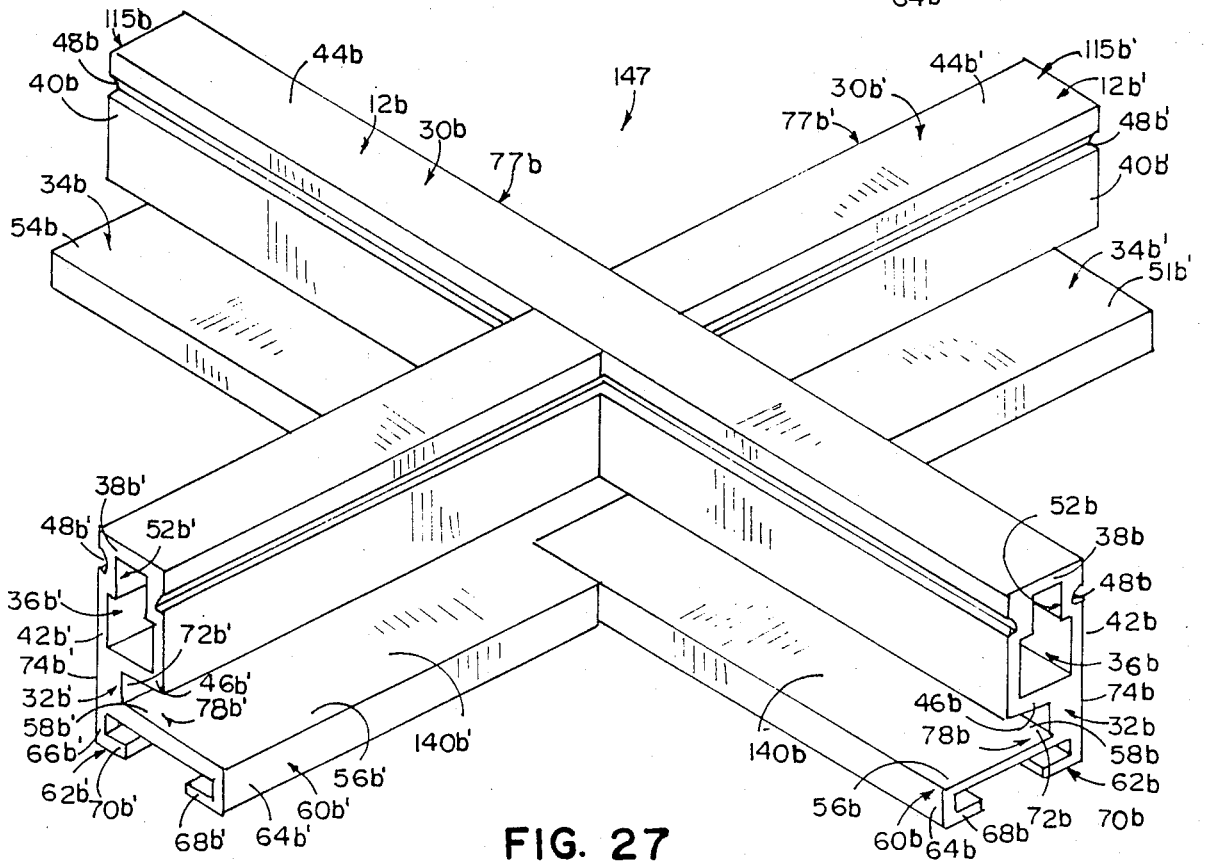
FIG. 27 is a perspective view of a pair of intersecting frame members of FIG. 25.

In forming the rectangular grid 20 of grid display 10, inner frame members 12b cross one another at the interior corners 145 of insert openings 24 (FIGS. 5 and 8). This crossing interconnection is facilitated by specially cutting each intersecting frame member 12b to matingly interfit with a corresponding frame member 12b'. In a first embodiment 147 (FIGS. 25 and 27), an upper frame member 12b is provided with a kerf 149 which extends completely through base 34b, neck 32b and partially upwardly through the lower portion of head 30b. Kerf 149 is dimensioned to have a uniform width equal to the width of head 30b' of the lower frame member 12b'. To complement upper frame member 12b, lower frame member 12b' is provided with a pair of spaced apart cut-outs 151, 153. First cut-out 151 is provided in the upper portion of head 30b' such that it extends downwardly approximately halfway therealong and has a width substantially equal to the width of head 30b of upper frame member 12b. Second cut-out 153 is provided through the portion of base 34b' which extends outwardly beyond head 30b' and is dimensioned to equal the width of base 34b of upper frame member 12b. Furthermore, second cut-out 153 includes one border wall 155 which is aligned with a marginal sidewall 157 of first cut-out 151 for properly fitting with upper frame member 12b as will be described below.

Upper and lower frame members 12b, 12b' are interfitted in a manner such that kerf 149 is aligned with first cut-out 151. Upper frame member 12b is then moved downwardly such that kerf 149 receives head 30b' therethrough until its upper face 159 abuts lower face 161 of first cut-out 151. In this arrangement (FIG. 27), base 34b of upper frame member 12b is matingly received within second cut-out portion 153. Rear surface 77b of upper frame member 12b is positioned in contiguous relationship with marginal sidewall 157 and border wall 155 of cut-outs 151, 153, respectively. Furthermore, one sidewall 165 of kerf 149 is in contiguous relationship with the rear wall 77b' of lower frame member 12b'.

Figure 26:
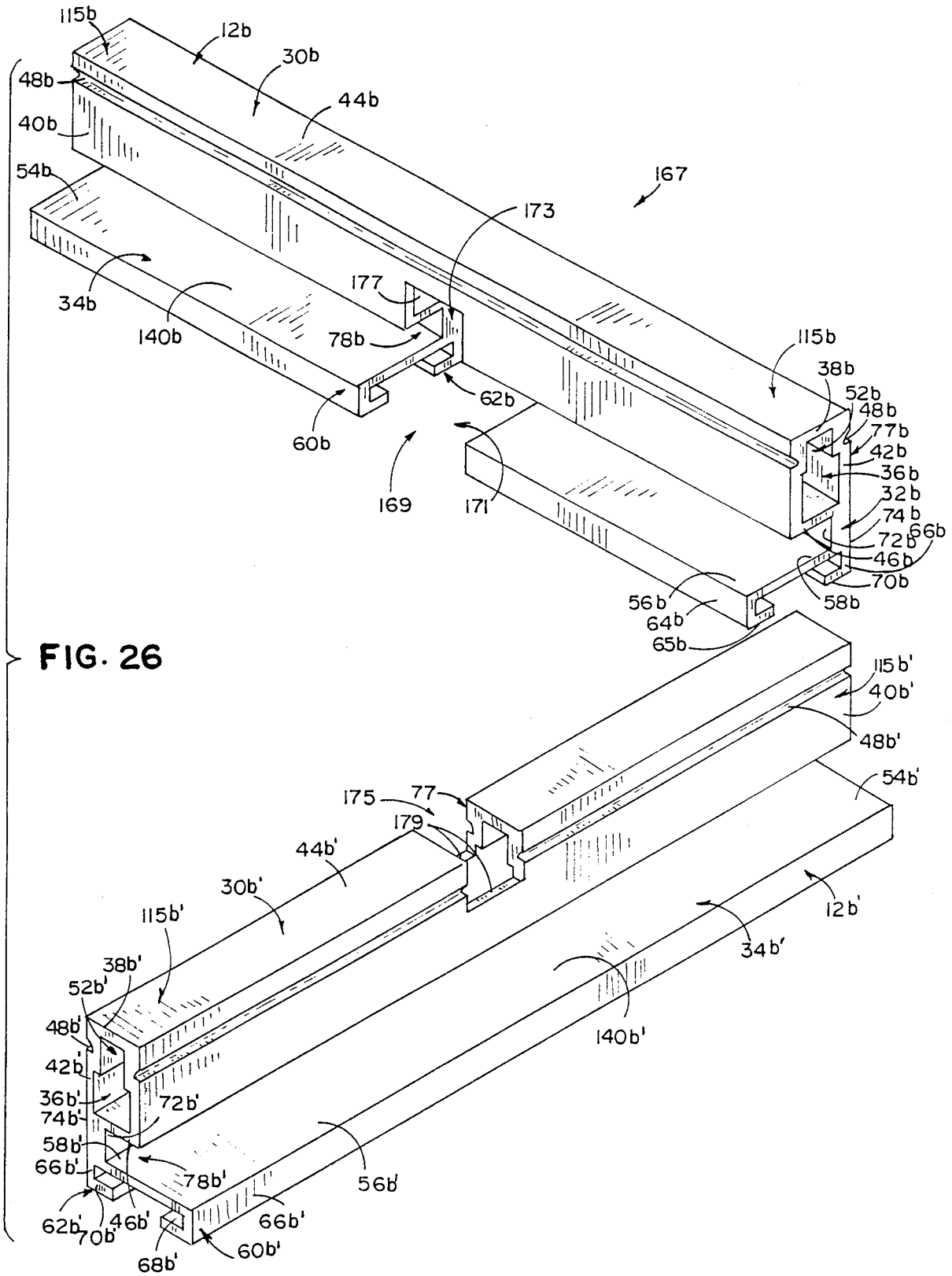
FIG. 26 is an exploded perspective view of a second embodiment of a pair of intersecting frame members.
Figure 28:
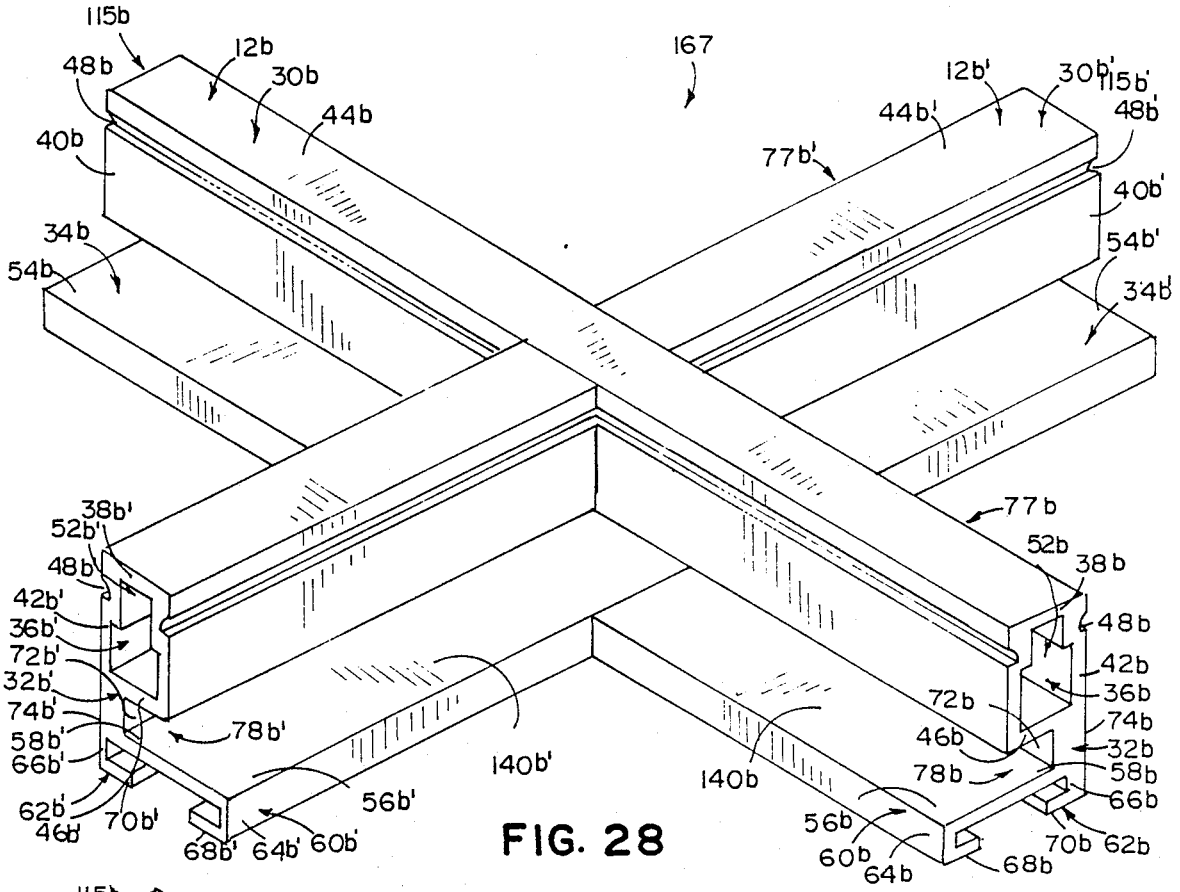
FIG. 28 is a perspective view of a pair of intersecting frame members of FIG. 26.

In a second embodiment 167 (FIGS. 26 and 28), upper frame member 12b is provided with a downwardly opening cut-out 169 which has a non-uniform width. More specifically, lower portion 171 of cut-out 169 defined within base 34b has a width which equals the width of base 34b' of lower frame member 12b'. However, the upper portion 173 of cut-out 169, received within neck 32b and lower portion of head 30b, is of a reduced width which equals the width of head 30b' of lower frame member 12b'. Lower frame member 12b' is provided with a single upwardly extending kerf 175 having a width equal to the width of head 30b of upper frame member 12b.

In the interconnection of these two frame members 12b, 12b', upper portion 173 of cut-out 169 is aligned with kerf 175. Upper frame member 12b is then moved downwardly over lower frame member 12b' until upper surface 177 of cut-out 169 engages lower surface 179 of kerf 175. In this orientation (FIG. 28), base 34b' is matingly received within lower portion 171 of cut-out 169, and head 30b' is matingly received within upper portion 173 of cut-out 169.

In the forming of a grid display 10 having an angular grid 22 (FIG. 10), the peripheral outer frame 113 is formed in the same manner as discussed above in the assembly of a rectangular grid 20. However, the interior frame members 12b are arranged diagonally thereto, rather than orthogonally. In this arrangement, diamond-shaped insert openings 26 form the interior pattern of display 10, and triangularly-shaped insert openings 28 are formed along the edges thereof. Preferably, inner frame members 12b are positioned at a 45 degree angle to outer frame members 12a; however, other angles could be utilized upon modifications of cross-shaped channels 107 of main connector elements 14.

Figure 19:
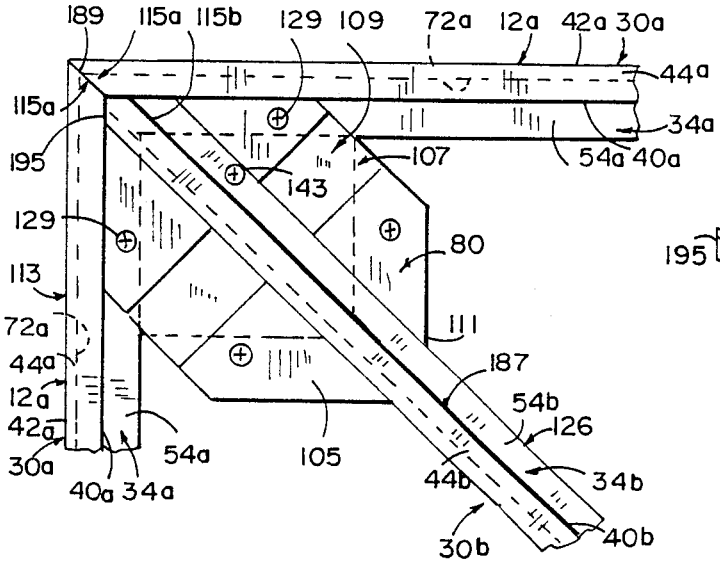
FIG. 19 is a front view of another corner of the grid display of FIG. 10.

More specifically, outer peripheral frame 113 is secured together in its corners 117 by a main connector element 14 in the same manner as described for first embodiment 20. However, in embodiment 22, an inner frame member 12b is received within second passage 111 of each corner connector element 14 to intersect and split corner 117 (FIGS. 9 and 19). Similarly to the receipt of inner frame members 12b in first passages 109 in first embodiment 20, base 34b is matingly received within second passage 111.

Further, each inner frame member 12b received into a corner 117 is positioned such that the longitudinal axis 187b of head 30b aligns with seam 189 formed at apex 181 of corner 117 for aesthetic purposes (FIGS. 9, 10 and 19). In the illustrated embodiment, the alignment of axis 187b with seam 189 is preferably accomplished by specially machining second passage 111 to orient the longitudinal axis 191 thereof to be offset from the apexes 193 of corners 98. The amount of offset needed will depend upon the relative width of head 30b as compared to the width of base 34b. Also, if it is desired that inner frame members 12b be positioned at angles other than 45 degrees, then similarly second passages 111 may be machined to have an orientation needed to effect the desired appearance.

Figure 9A:
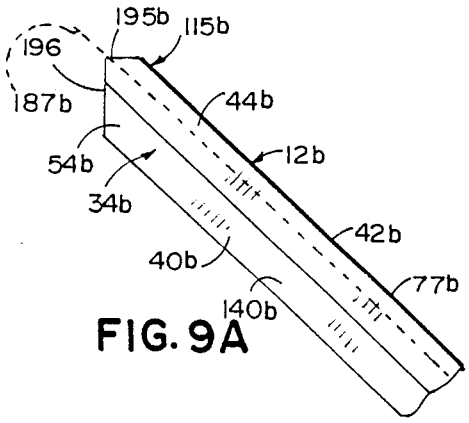
FIG. 9A is a front view of the frame member oriented diagonally in FIG. 9.
Figure 9:
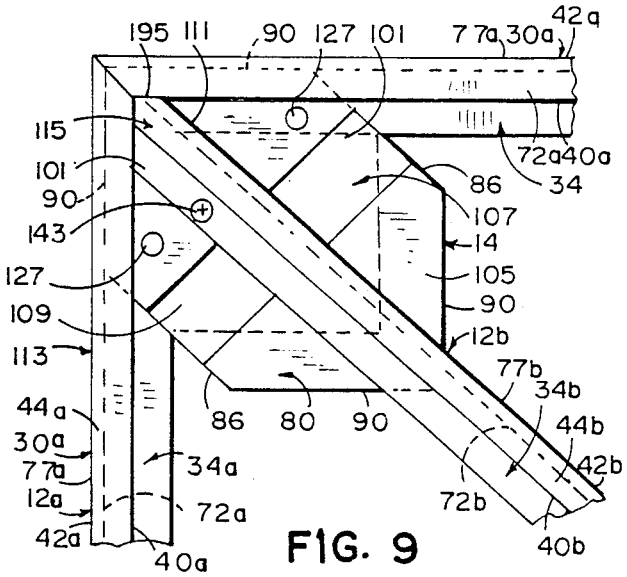
FIG. 9 is a front view of a corner of the grid display of FIG. 10.
Figure 19A:
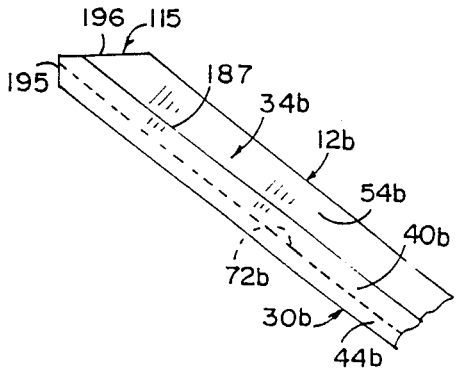
FIG. 19A is a front view of the frame member mounted diagonally in FIG. 19.

Also, as illustrated in FIGS. 9A and 19A, the ends 115b of inner frame members 12b engaging the corners 117 are cut to form a point substantially aligned with the longitudinal axis 187*b* of head 30*b*. The defined walls 195, 196 permit the inner frame members 12*b* to be matingly received into corners 117. More specifically, chamfered wall 195 is in contiguous abutment with sidewall 40*a* of one outer frame member 12*a* and chamfered wall 196 is in contiguous abutment with sidewall 40*a* of the other outer frame member 12*a*. To suit other orientations of heads 30*b* with respect to corner 117, ends 115*b* would accordingly require different shaping. In any event, inner frame members 12*b* are secured in the same manner as described for first embodiment 20; that is, by forming bores 141 in base 34*b* and connector 14 and inserting therein fasteners 143.

The intersections of inner frame members 12*b* (FIGS. 8 and 25–28) in the angular grid embodiment 22 are formed, secured, and mounted in the same manner as described above for rectangular grid 20. The only difference being the orientation of main connector elements 14 in angular grid 22 is rotated 45 degrees relative to their orientation in the formation of the rectangular grid 20.

Figure 11:
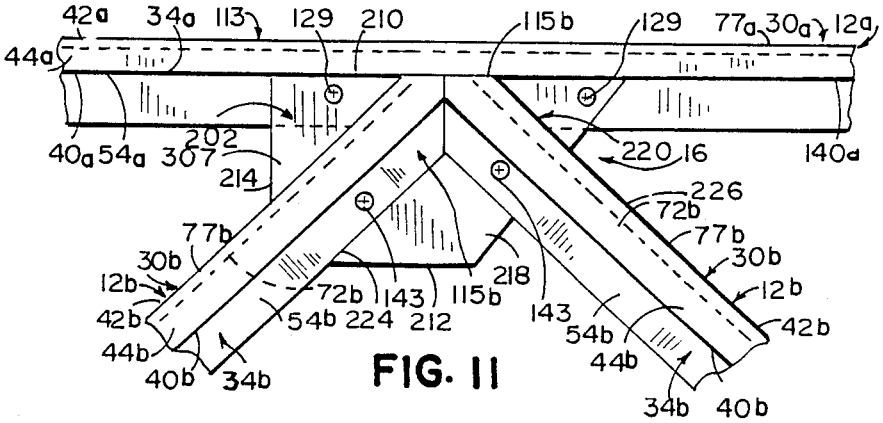
FIG. 11 is a front view of an end intersection of the grid display of FIG. 10.
Figure 11A:
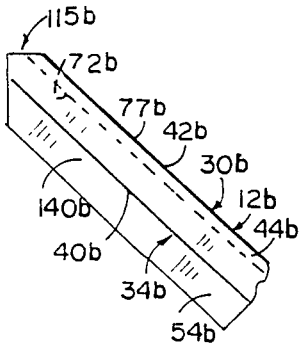
FIG. 11A is a front view of one of the frame members oriented on the diagonal in FIG. 11.
Figure 12:
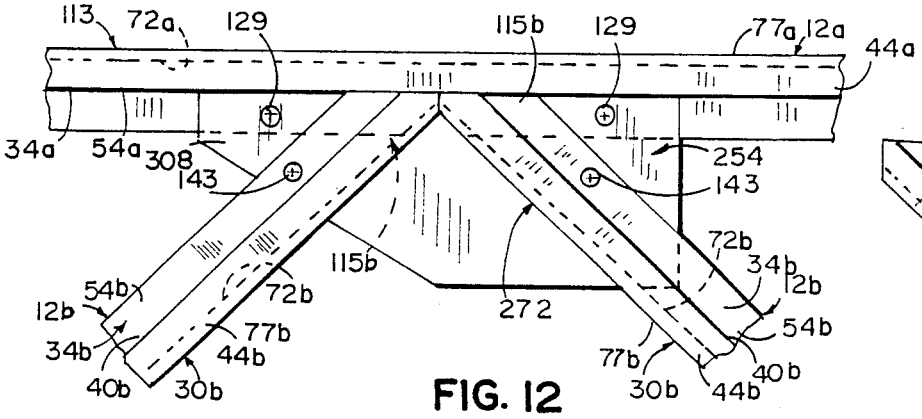
FIG. 12 is a front view of another end intersection of the grid display of FIG. 10.
Figure 12A:
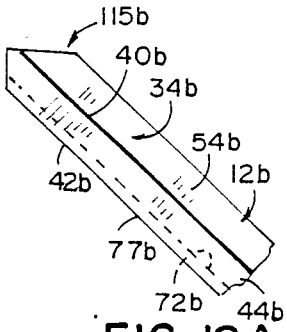
FIG. 12A is a front view of one of the frame members mounted on the diagonal in FIG. 12.

Alternative connector elements 16, 18 are employed to intersect diagonally oriented inner frame members 12*b* intermediately along the length of outer frame members 12*a*. As seen in FIG. 10, alternative connector elements 16, 18 orient and position three intersecting frame members 12 in a particular configuration. One alternate connector element 16 is utilized when the heads 30*b* of the inner frame members 12*b* are spaced outwardly relative to outer frame members 12*a*; that is, when rear surfaces 77*b* of inner frame members 12*b* are facing outer frame member 12*a* (FIGS. 10 and 11). The other alternative connector element 18 is utilized when the heads 30*b* of inner frame members 12*b* are positioned inwardly relative to outer frame members 12*a*; that is, when rear surfaces 77*b* of inner frame members 12*b* face away from the intersected outer frame member 12*a* (FIGS. 10 and 12).

When assembling an angular grid type 22 grid display 10 having a square outer peripheral frame 113 (and in some rectangularly-shaped peripheral frames), only one type of secondary connector element 16 or 18 need be used, although both may be used if desired. However, some grid displays 10 having a rectangularly-shaped outer peripheral frame 113 will require the use of both secondary connector elements 16, 18 due to the intersections thereby created.

The first alternative connector element 16 has a three-layer construction similar to main connector element 14 (FIGS. 11 and 13–15). More specifically, connector element 16 includes a front layer 202, a rear layer 204 and an interlayer 206 sandwiched therebetween and bonded therewith to form a single integral article. Connector element 16 may also be fabricated, by molding or machining, as a single-piece, unitary member having the same three-layer form. Front and rear layers 202, 204 are generally planar members which define outer edges 210, 211, inner edges 212, 213, a pair of side edges 214, 216 and auxiliary edges 215, 217. The irregular shape is utilized only to facilitate an easier manufacturing procedure. The shape, therefore, is not critical and a wide variety of shapes could be utilized.

Front layer 202 is provided along its outer face 218 with a substantially V-shaped channel 220 oriented such that its apex 222 is directed toward the midpoint of outer edge 210. Preferably, the intersecting passageways 224, 226 forming channel 220 are orthogonally positioned relative to one another and extend outwardly toward corner 225 and auxiliary edge 215. Nevertheless, other passageway orientations could be employed if inner frame members 12*b* are positioned at an angle other than 45 degrees to outer frame members 12*a*.

As shown in FIG. 11, inner frame members 12*b* are mitered at their ends 115*b* and positioned in passageways 224, 226 so that their ends 115*b* are in an abutting relationship with one another. Ends 115*b* are further cut to define an end wall 227 in abutting relationship with sidewall 40*a* of outer frame member 12*a*. Also, inner frame members 12*b* are securely attached to first alternative connector element 16 by forming a bore 141 through each base 34*b* and into connector 16 for the insertion of fasteners 143.

Interlayer 206 possesses a substantially triangular configuration having a point which lies near, but is offset inwardly from, the midpoint of outer edges 210, 211 (FIG. 13). In the preferred embodiment, interlayer 206 defines a pair of abutment walls 240, 242 which are positioned orthogonally to one another and parallel to sidewalls 244, 246 of passageways 224, 226. In facilitating the mounting of first alternative connector element 16, outer frame member 12*a* is provided with a V-shaped notch 139 in the same manner as when forming the rectangular grid embodiment 20 as discussed above. Base 34*a* is then received within gap 250 formed between front and rear layers 202, 204 such that notch 139 matingly receives the outer pointed portion 248 of interlayer 206.

Second alternative connector element 18 (FIGS. 12 and 16–18) is similar in shape to first alternative connector element 16. More particularly, connector element 18 includes a front layer 254, a rear layer 256 and an interlayer 258 sandwiched therebetween and bonded therewith to form a single integral article. Connector element 18 may also be fabricated, by molding or machining, as a single-piece, unitary member having the same three-layer form. Front and rear layers 254, 256 are generally planar members which define outer edges 260, 261, inner edges 264, 265, side edges 268, 270 and auxiliary edges 269, 271. Again, as with connector 16, the irregular shape is not critical, and connector 18 could be fabricated with a wide variety of configurations.

Front layer 254 is further provided with a truncated V-shaped channel 272 such that the outer apex of the channel is nonexistent and the inner apex 274 is offset from outer edge 260 a predetermined distance dependent upon the width of heads 30*b* of inner frame members 12*b* (FIG. 12). Passageways 276, 278 in the preferred embodiment, are positioned orthogonally to one another and extend outwardly toward corner 282 and auxiliary edge 269. Furthermore, in like manner to the use of alternative connector element 16, the ends 115*b* of the inner frame members are mitered to abut one another and cut to define an end wall 284 in abutment with sidewall 40*a* of outer frame member 12*a*. Also, as with the mounting of the other inner frame members 12*b*, a pair of bores 141 are formed through bases 34*b* and into connector element 18 for the receipt of fasteners 143.

Second alternative connector element 18 includes an interlayer 258 which is substantially identical to inner layer 206 of connector element 16 (FIG. 16). More specifically, interlayer 258 is generally triangular in shape and is oriented such that one corner 292 is near, but slightly offset from, the midpoint of outer edges 260, 262. Further, abutment walls 294, 296 are provided to be received within and engage notch 139 provided in outer frame member 12*a*. Consequently, second alternative connector element 18 is mounted upon outer frame member 12*a* in a manner identical to first alternative connector element 16.

Display inserts 29 are mounted into the above described frameworks in the same manner, regardless of whether one is forming a rectangular grid 20 or an angular grid 22 (FIG. 20). More specifically, display inserts 29 may be formed as pictures, fabric covered panels, wood panels, etched or laminated glass panels, awards, composite granite or a number of other items.

One embodiment 300 utilizes retaining strips 50 to secure display inserts 29 which include a transparent cover panel or are heavy. In one example, display insert 29 includes a print 301 having thereon a picture, design or color intended to form a component of the overall array of inserts. Print 301 is bonded to a substrate 303 by a conventional pressure-sensitive adhesive (not shown). Substrate 303 is preferably a plastic material having a solid or hollow construction. Mounted over print 301 is a transparent pane 305 of glass or plastic, designed to cover and protect print 301 from marring or damage.

Display inserts 29 are received within insert receiving openings 24, 26, 28 such that the rear surface 306 of substrate 303 is placed in abutment, near its corners, with the upper surfaces 105, 307, 308 of connector elements 14, 16, 18, respectively. The utilization of connector elements 14, 16, 18 to form a backing layer is particularly beneficial in the mounting of the display 10 to an irregular wall surface, such as brick. This arrangement, then, ensures a uniform and flat appearance for all the display inserts 29 included within the display 10.

In embodiment 300, display inserts 29 are secured within insert openings 24, 26, 28 through the use of elongated retaining strips 50 which are preferably formed of plastic, but of course could be formed of a variety of materials (FIG. 20). More specifically, retaining strips 50 include body portions 309 and tail portions 311. Tail portion 311 is an elongated segment having a reduced width dimension as compared to body portion 309 such that a securing shoulder 312 is thereby defined. Further, body and tail portions 309, 311 are aligned along one edge to form an elongated abutment surface 315 which is adapted to engage a sidewall 40 or 42 of a frame member 12 as will be discussed below. Opposite abutment surface 315, body portion 309 is provided with an arcuate outward surface 317 which is visible to the observer once grid display 10 is assembled. Hence, the surface may be given any desired shape to provide the desired visual effect. Projecting outwardly from abutment surface 315, along the length of retaining strips 50, is provided a securing ridge 319 which acts to mount retaining strips 50 onto frame members 12.

Securing ridges 319 have a generally hemispherical configuration and are dimensioned for receipt within grooves 48 (FIG. 20). The engaged arcuate surfaces of groove 48 and ridge 319 are designed to securely hold retaining strips 50 under ordinary conditions, but also to permit easy release thereof when the user desires to change or modify the array of display inserts. Hence, with this construction, once grid display 10 is assembled and secured to the wall or other supporting surface 135, the user may change and modify the array of display inserts without disassembling any of the grid pattern 20, 22 by simply removing retaining strips 50.

In assembling grid displays 10, retaining strips 50 are provided around the periphery of each individual display insert 29. Hence, the ends are preferably mitered to form an aesthetically pleasing seam in the corners 117. Retaining strips 50 are positioned about display insert 29 such that tail portions 311 extend downwardly between display insert 29 and heads 30 of frame members 12, and securing shoulders 312 overlie and engage display insert 29 to thereby hold it within a display insert receiving opening 24, 26, 28. Retaining strips 50 are assembled into position by resiliently forcing them downwardly until the securing ridge 319 is received within the corresponding shallow groove 48.

Figure 29:
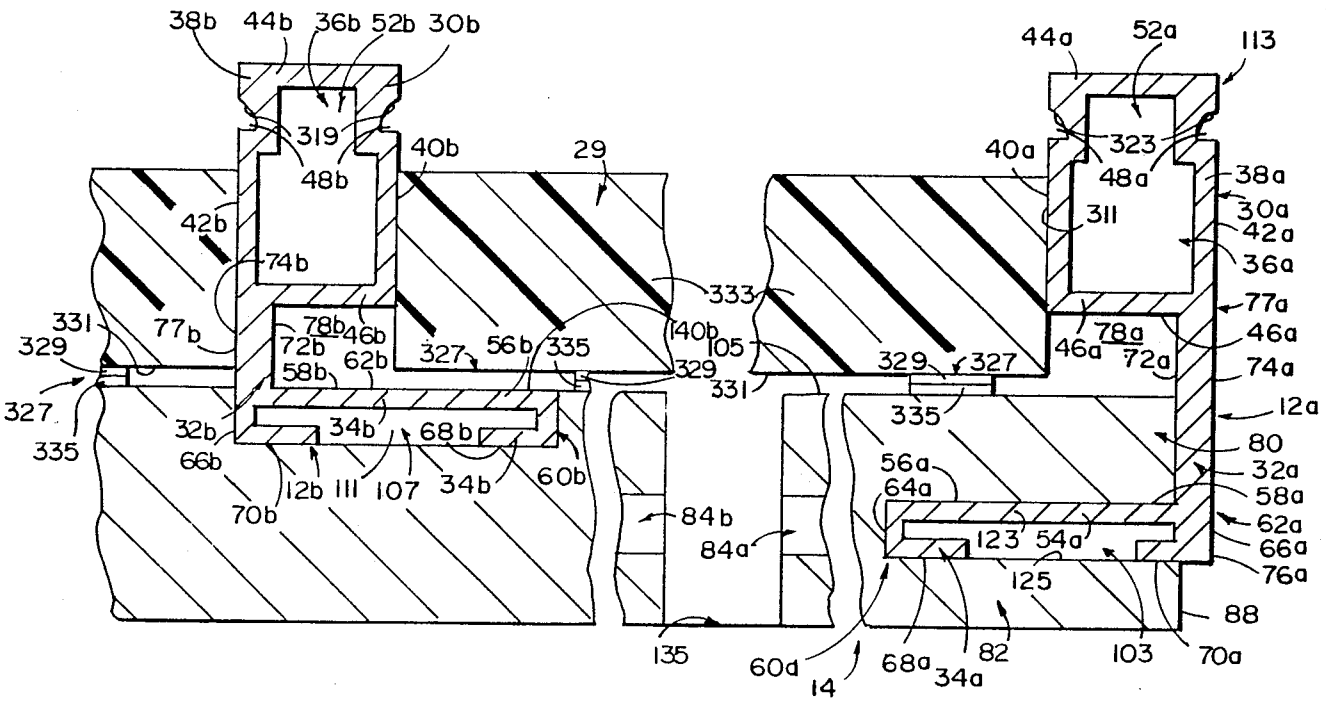
FIG. 29 is a cross-sectional view of a second embodiment taken along line XX—XX in FIG. 5.

A second embodiment 325 is provided to employ VELCRO retaining elements 327 or double-sided adhesive tape (not shown) to be utilized whenever the display inserts 29 are of a relatively light, one-piece construction (FIG. 29). More particularly, one VELCRO element 329 is mounted to the rear surface 331 and in each corner 333 of the display insert 29. A corresponding VELCRO element 335 is secured to the upper surface of the connector elements 14, 16, 18 in positions which engage the VELCRO element 329 of display inserts 29. Similarly, when utilizing the double-sided adhesive tape, the tape would be placed in the same locations as the VELCRO elements, except of course that there would only be one element in each corner rather than two engaged elements. Either of these constructions, then, facilitate easy front mounting and removal of the various display inserts 29.

Of course, it is understood that the above are merely preferred embodiments of the invention, and that various other embodiments as well as many changes and alterations may be made without departing from the spirit and broader aspects of the invention as defined in the claims.

The embodiments of the invention in which an exclusive property or privilege is claimed are defined as follows:

1. A grid display for mounting a number of display insert units comprising:

a plurality of elongate frame members cooperatively interconnected to form a plurality of openings for receiving the display inserts, a number of said frame members being interconnected to form an outer peripheral frame confining a certain space, and a number of said frame members being positioned to divide the confined space into a plurality of openings for receiving the display inserts, each said frame member having an upraised portion and a base portion, said frame members dividing said confined space extending thereacross in crossing intersecting relationships and further including cut-outs cooperating with one another to form a substantially planar grid pattern;

a plurality of connector elements each including a peripheral surface having a gap, said gaps being adapted to receive said base portions of said frame members defining the outer peripheral frame to support them in their proper positions; and means for retaining said display insert unit in said openings formed by said frame members.

2. The grid display of claim 1 in which each said connector element includes a generally cross-shaped channel adapted to receive said base portions of said dividing frame members in said crossing intersecting relationship.

3. The grid display of claim 2 in which each said connector element has a three-layer generally planar construction including a pair of outer layers and an interlayer fixedly secured together, wherein said interlayer is of a reduced size compared to said outer layers to thereby define said gap.

4. The grid display of claim 3 in which said connector elements are of a single-piece, unitary construction.

5. The grid display of claim 3 in which said means for retaining said display insert includes retaining elements releasably mounted to said frame members, whereby said display insert may be replaced without disassembling said frame members.

6. The grid display of claim 5 in which said upraised portions of said frame members each include a pair of sidewalls, wherein each said sidewall includes a groove extending along the length thereof, and in which said retaining elements are elongated strips which include a ridge adapted for mating receipt within said groove, whereby said retaining strips are securely but releasably secured to said frame members.

7. A grid display for mounting a plurality of display insert units comprising:

a plurality of elongate frame members cooperatively interconnected to form a plurality of openings for receiving the display inserts, a first number of said frame members being interconnected to form an outer peripheral frame confining a certain space, and a second number of said frame members being positioned to divide the confined space into a plurality of openings for receiving the display inserts, each said frame member having an upraised portion and a base portion;

a plurality of connector elements each including a peripheral surface having a gap and a front face having at least one channel, said gaps being adapted to receive said base portions of said first number of said frame members to support them in their proper position, and said channels being adapted to position and mount said second number of said frame members dividing the confined space; and means for retaining said display insert units in said openings formed by said frame members.

8. The grid display of claim 7 in which each said connector element has a three-layer generally planar construction including a pair of outer layers and an interlayer fixedly secured together, wherein said interlayer is of a reduced size compared to said outer layers to thereby define said gap.

9. The grid display of claim 8 in which said connector elements are of a single-piece, unitary construction.

10. A grid display for mounting at least one display insert unit comprising:

a plurality of elongate frame members cooperatively interconnected to form at least one opening for receiving said display insert, each said frame member having an upraised portion and a base portion;

a plurality of connector elements each including a peripheral surface having a gap, each said connector element further having a three-layer generally planar construction including a pair of outer layers and an interlayer fixedly secured together, said interlayer being of a reduced size compared to said outer layers to thereby define said gap, said gaps being adapted to receive said base portions of said frame members to support them in their proper position; and means for retaining said display insert unit in said opening formed by said frame members.

11. The grid display of claim 10 in which said connector elements are of a single-piece, unitary construction.

12. A grid display for mounting at least one display insert unit comprising:

a plurality of elongate frame members cooperatively interconnected to form at least one opening for receiving said display insert, each said frame member having an upraised portion and a base portion;

a plurality of connector elements each including a peripheral surface having a gap and at least one planar pad portion extending into said at least one opening, said gaps being adapted to receive said base portions of said frame members to support them in their proper position, and said pad portion being adapted to provide a support surface for said at least one display insert; and means for retaining said display insert unit in said opening formed by said frame members.

13. The grid display of claim 12 further including at least one pair of cooperating VELCRO elements, wherein one VELCRO element is mounted to said display insert and the other VELCRO element is mounted to said planar pad portion whereby said VELCRO elements are adapted to engage with one another and releasably secure said display insert in said opening.

14. A grid display comprising:

a number of display inserts;

a plurality of frame members; and a plurality of connector elements each having a generally planar configuration, a peripheral surface and a front face, said peripheral surface including a gap adapted to receive a portion of certain of said frame members for forming an outer peripheral frame, and said front face including a channel adapted to receive a portion of certain of said frame members for positioning within said peripheral frame to form a number of openings for receiving said display inserts.

15. The grid display of claim 14 in which each said connector element has a three-layer construction including a pair of outer layers and an interlayer fixedly secured together, wherein said interlayer is smaller than said outer layers to thereby form said gap.

16. The grid display of claim 15 in which said connector elements are of a single-piece, unitary construction.

17. The grid display of claim 14 in which said channel is generally cross-shaped to receive said frame members positioned within said peripheral frame in crossing intersecting relationships such that a grid is formed, whereby an array of display inserts may be displayed.

18. The grid display of claim 14 in which said outer layers are generally hexagonal in shape and said interlayer is generally square in shape, wherein said interlayer is shaped and oriented to define with said outer layers a pair of opposite generally V-shaped gaps.

19. A display for mounting a plurality of display inserts comprising:

a framework having a front side and defining a plurality of display insert receiving openings for forming an array of display inserts, said framework further including a groove provided around the periphery of each said defined opening between said received display insert and said front side; and a plurality of retaining strips defined by elongate lengths having substantially uniform cross sections positioned substantially around the entire periphery of each said display insert receiving opening, each said retaining strip including a retaining shoulder adapted to overlie one of said display inserts and retain said display insert in said opening, and a ridge adapted to be received within said groove to releasably mount said retaining strip to said framework, so that said display inserts can be inserted into and removed from said openings from the front side of said framework by removing said retaining strips from said framework and without disassembling said framework.

20. A grid system for displaying a plurality of display units in juxtaposed relationship comprising:

a plurality of grid members interconnected to define a plurality of juxtaposed openings, each having a front and a back, each of said grid members including an upstanding portion separating two of said openings, said upstanding portions being configured so that a planar display unit can be inserted into one of said openings from the front of said opening in a direction generally perpendicular to the display unit; and retaining means releasably secured to said upstanding portions for retaining the display units within the openings.

21. A grid system as defined in claim 20 further comprising a plurality of connectors adapted to be secured to a support surface and including alignment means for receiving said grid members, said connectors each including at least one planar pad portion extending into one of said openings to provide a support surface for one of the display units.

22. A grid system as defined in claim 20 in which said upstanding portion of said grid members each include a pair of sidewalls, wherein each sidewall includes a groove extending along the length thereof, and in which said retaining means includes a plurality of retaining strips each having a ridge adapted for receipt within one of said grooves, whereby said retaining strips are releasably secured to said grid members.

23. A kit for assembling a grid display adapted to mount a number of display inserts comprising:

a number of first frame members for forming an outer peripheral frame, each said first frame member including an upraised portion and a base portion, said upraised portions each having a top edge;

a number of second frame members adapted to be positioned in either of two arrangements including positioning within said formed outer peripheral frame to define therein a number of display insert receiving openings and positioning as an alternate outer peripheral frame, said second frame members each including an upraised portion and a base portion, said upraised portions each having a top edge, said upraised portions of said second frame members being smaller than said upraised portions of said first frame members;

a number of third frame members for positioning within said formed alternate outer peripheral frame to define therein a number of display insert receiving openings, each of said third frame members including an upraised portion and a base portion, said upraised portions each having a top edge, said upraised portions of said third frame members being smaller than said upraised portions of said second frame members; and a number of connector elements having the capacity to interconnect said first and second frame members into a desired configuration such that said top edges of said first and second members are in a substantially planar relationship, and alternatively interconnect said second and third frame members into an alternate desired configuration such that said top edges of said second and third members are in a substantially planar relationship.

24. The kit of claim 23 wherein said base portions of said first, second, and third frame members are all generally of the same shape and size so as to be interchangeably coupled with said connector elements to form said desired configurations.

25. The kit of claim 23 wherein said first, second, and third frame members all have a generally L-shaped configuration.

26. A kit for assembling a grid display adapted to mount a number of display inserts comprising:

a number of first frame members for forming an outer peripheral frame, each said first frame member including an upraised portion and a base portion;

a number of second frame members for positioning within said formed outer peripheral frame and defining therein a number of display insert receiving openings, said second frame members each including an upraised portion and a base portion, said upraised portions of said second frame members being smaller than said upraised portions of said first frame members; and a number of connector elements for interconnecting said first and second frame members into a desired configuration, each said connector element including a gap for receiving and mounting said base portions of said first frame members and a channel provided on a front face for receiving and mounting said base portions of said second frame members.

27. The kit of claim 26 in which said connector element has a three-layer generally planar construction including a pair of outer layers and an interlayer fixedly secured together, wherein said interlayer is sized and oriented to define with said outer layers said gap.

28. The grid display of claim 27 in which said connector elements are of a single-piece, unitary construction.

29. The kit of claim 26 in which said channel of said connector element is generally cross-shaped to receive said base portions of said second frame members in a crossing intersecting relationship.

30. A kit for assembling a grid display adapted to mount a number of display inserts comprising:

a number of first frame members for forming an outer peripheral frame, said peripheral frame having a forward side and a rearward side, each said first frame member including an upraised portion and a base portion;

a number of second frame members for positioning within said formed outer peripheral frame and defining therein a number of display insert receiving openings so that said display inserts are displayed and observed from the forward side of the peripheral frame, said second frame members each including an upraised portion and a base portion, said upraised portions of said second frame members being smaller than said upraised portions of said first frame members; and a number of connector elements for interconnecting said first and second frame members along said rearward side of said peripheral frame into a desired configuration, each said connector element further including at least one planar pad portion extending into one of said openings rearwardly of the display inserts to provide a support surface for one of the display inserts.

31. A kit for assembling a grid display adapted to mount a number of display inserts comprising:

a number of first frame members for forming an outer peripheral frame, each said first frame member including an upraised portion and a base portion;

a number of second frame members for positioning within said formed outer peripheral frame and defining therein a number of display insert receiving openings, said second frame members each including an upraised portion and a base portion, said upraised portions of said second frame members being smaller than said upraised portions of said first frame members;

a number of first connector elements for interconnecting said first and second frame members into a desired configuration such that said second frame members are orthogonally arranged relative to said first frame members; and a number of second connector elements each having a gap and a generally V-shaped channel, said gaps being adapted to receive intermediate segments of said base portions of said first frame members, and said channels being adapted to receive and mount each of said second frame members at an acute angle orientation to said first frame members.

32. A kit for assembling a grid display adapted to mount a number of display inserts comprising:

a number of first frame members for forming an outer peripheral frame, each said first frame members including an upraised portion and a base portion;

a number of second frame members for positioning within said formed outer peripheral frame and defining therein a number of display insert receiving openings, said second frame members each including an upraised portion and a base portion, said upraised portions of said second frame members being smaller than said upraised portions of said first frame members;

a number of connector elements for interconnecting said first and second frame members into a desired framework configuration, said framework having a front and rear side; and a number of retaining strips adapted to releasably mount to said first and second frame members for retaining said display inserts within said defined openings, each said retaining strip including a retaining shoulder adapted to overlie said display insert and retain said display insert in said opening so that said display insert can be inserted into and removed from said opening from the front of said framework by removing said retaining strips from said framework and without disassembling said framework.

33. A kit for assembling a grid display adapted to mount a number of display inserts comprising:

a number of first frame members for forming an outer peripheral frame, each said first frame member including a base portion and an upraised portion having a pair of opposite sidewalls, each said sidewall including a groove extending along the length thereof;

a number of second frame members for positioning within said formed outer peripheral frame and defining therein a number of display insert receiving openings, said second frame members each including a base portion and an upraised portion having a pair of opposite sidewalls, each of said side walls including a groove extending along the length thereof, said upraised portions of said second frame members being smaller than said upraised portions of said first frame members;

a number of connector elements for interconnecting said first and second frame members into a desired framework configuration having a front face; and a number of retaining strips adapted to releasably mount to said first and second frame members for retaining said display inserts within said defined openings, said retaining strips each including a ridge adapted for receipt within one of said grooves, such that said retaining strips are releasably mounted to said first and second frame members to facilitate insertion and removal of said displays inserts from the front of the defined framework.

* * * * *

UNITED STATES PATENT AND TRADEMARK OFFICE

CERTIFICATE OF CORRECTION

PATENT NO. : 4,964,231

DATED : October 23, 1990

INVENTOR(S) : H. Thomas De Maat et al

It is certified that error appears in the above-identified patent and that said Letters Patent is hereby corrected as shown below:

Claim 19, Column 12, Line 66:
"elongate" should be --elongated--.

Claim 32, Column 15, Line 34:
"members" should be --member--.

Signed and Sealed this

Nineteenth Day of May, 1992

*Attest:*

DOUGLAS B. COMER

*Attesting Officer*

*Acting Commissioner of Patents and Trademarks*